US006340006B1

(12) United States Patent
Malatto et al.

(10) Patent No.: US 6,340,006 B1
(45) Date of Patent: Jan. 22, 2002

(54) INTERNAL COMBUSTION ENGINES HAVING SEPARATED COOLING CIRCUITS FOR THE CYLINDER HEAD AND THE ENGINE BLOCK

(75) Inventors: Dante Rodolfo Malatto; Fiorello Losano; Sergio Occella; Vladimiro Patrone, all of Orbassano (IT)

(73) Assignee: C.R.F. Societa Consortile per Azioni, Turin (IT)

( * ) Notice: Subject to any disclaimer, the term of this patent is extended or adjusted under 35 U.S.C. 154(b) by 0 days.

(21) Appl. No.: 09/523,959

(22) Filed: Mar. 13, 2000

(30) Foreign Application Priority Data

Mar. 11, 1999 (IT) ..... TO99A0186

(51) Int. Cl.[7] ..... F01P 3/00
(52) U.S. Cl. ..... 123/41.29; 123/41.42
(58) Field of Search ..... 123/41.29, 41.42

(56) References Cited

U.S. PATENT DOCUMENTS 4,348,991 A * 9/1982 Stang et al. ..... 123/41.29
4,759,316 A * 7/1988 Itakura ..... 123/41.08
4,926,800 A * 5/1990 Valev ..... 123/41.42
5,497,734 A * 3/1996 Okada ..... 123/41.1

* cited by examiner

*Primary Examiner*—Tony M. Argenbright
*Assistant Examiner*—Katrina B. Harris
(74) *Attorney, Agent, or Firm*—Sughrue Mion, PLLC

(57) ABSTRACT

A cooling system for an internal combustion engine includes a first circuit for cooling the cylinder head and a second circuit for cooling the engine block which are completely separated from each other and make use of a first fluid and a second fluid which are never mixed with each other. The flow of the first fluid circulating in the circuit for cooling the cylinder head is used, totally or partially, for cooling the second fluid which cools the engine block in a heat exchanger. Preferably, the second cooling fluid is the engine lubricating oil.

7 Claims, 2 Drawing Sheets

Figure 1:
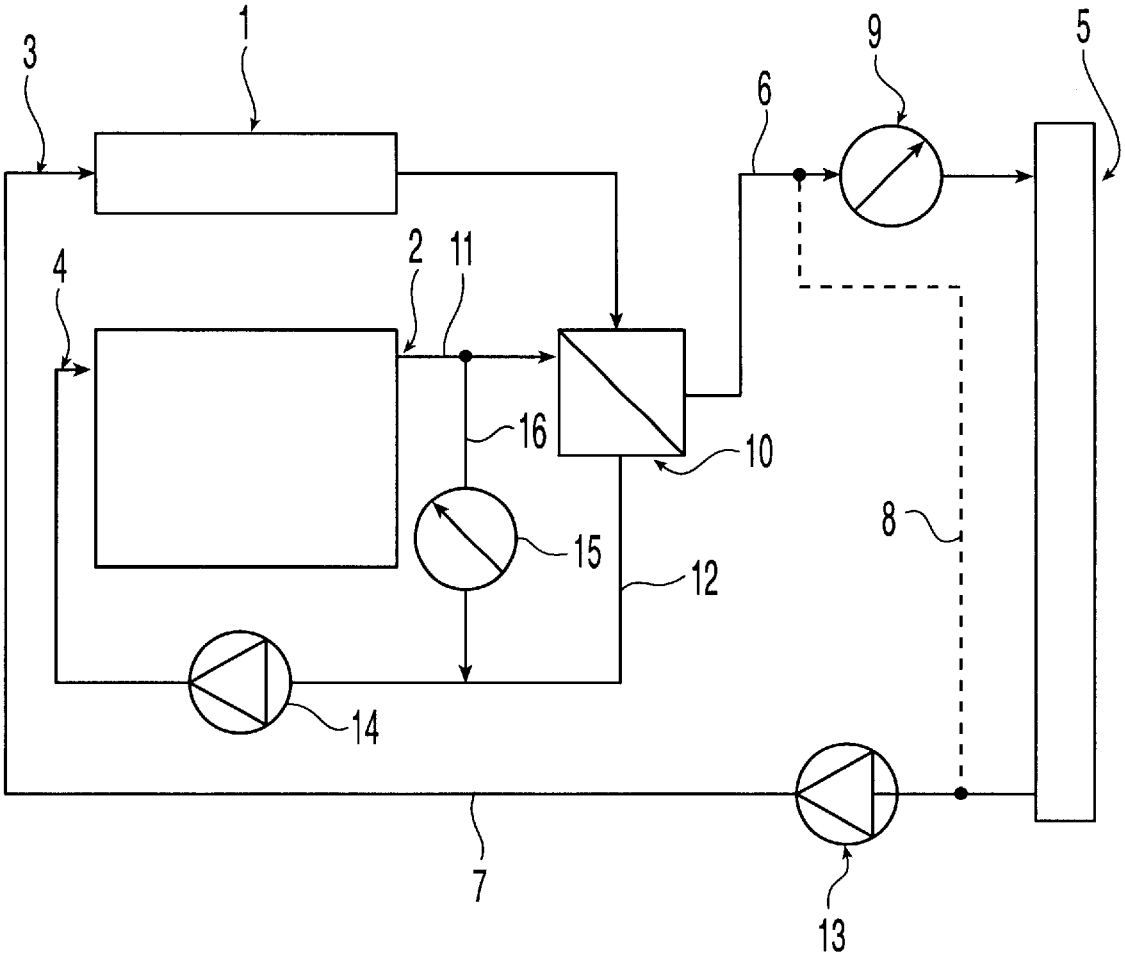

INTERNAL COMBUSTION ENGINES HAVING SEPARATED COOLING CIRCUITS FOR THE CYLINDER HEAD AND THE ENGINE BLOCK

The present invention relates to cooling systems for internal combustion engines.

The object of the present invention is that of providing a cooling system which has a high efficiency while having also a relatively simple and inexpensive structure. A further object is that of improving the efficiency of the engine, particularly by reducing the fuel consumption and the emission of noxious gases.

In view of achieving the above mentioned object, the invention provides an internal combustion engine comprising an engine block and a cylinder head, characterized in that said engine comprises a cooling system including:

- a first circuit for cooling the cylinder head of the engine and a second circuit for cooling the engine block, which are completely separated from each other and make use of a first cooling fluid and a second cooling fluid respectively which are never mixed with each other, and
- a liquid/liquid heat exchanger having two ways respectively interposed in the first circuit for cooling the cylinder head and in the second circuit for cooling the engine block, in order to transfer heat between said two fluids.

In the cooling system according to the invention, the two circuits for cooling the head and the engine block are completely separated from each other, so that the temperatures of the two circuits are kept separate from each other. Due to the difference of the temperatures of the first fluid for cooling the head and the second fluid for cooling the block, the block can be brought to the desired temperature very easily, by varying the flow of the second cooling fluid or the flow of the first cooling fluid through the heat exchanger, since the fluid circulating in the engine block is normally cooled by the fluid which circulates in the head by means of said liquid/liquid heat exchanger.

According to a further preferred feature of the invention, the cooling fluid used in the circuit for cooling the engine block is a high boiling point fluid, i.e. a fluid having a boiling temperature substantially greater than that of the water. Due to this feature, the temperature of the engine block can be increased greatly above 100° C., such as up to 140° C. This result is possible, since the circuit for cooling the engine block is relatively small, there is a relatively small quantity of fluid contained therein and also this circuit can be sealed and placed at a protected position, with no additional tubes arranged in the engine compartment outside the engine. A further advantage lies in that any damages to the radiator of the system for cooling the cylinder head, for example due to an accident, do not cause inconveniences to the circuit for cooling the engine block.

In the preferred embodiment of the invention, the second cooling fluid is the engine lubricating oil. In this case, the above mentioned second circuit is arranged so that the lubricating oil, after that it has cooled the engine block, is sent to the heat exchanger to be cooled there by the first fluid of the first circuit for cooling the cylinder head, whereupon the oil thus cooled is sent to the circuit for lubrication of the engine block and the cylinder head. Also in the case of this preferred embodiment, the pump which activates circulation of the fluid in the circuit for cooling the engine block may be the same pump of the engine lubricating circuit, driven by the internal combustion engine, or also provided with an associated driving electric motor.

The above mentioned heat exchanger is interposed in a conduit of the first cooling of the cylinder head. In a first solution, in this conduit the entire flow of the first cooling fluid flows. In a variant, only a part of the entire flow of the first cooling fluid flows in this conduit.

The first circuit for cooling the cylinder head comprises:

- a radiator,
- an output conduit for feeding the first cooling fluid from the cylinder head to the radiator,
- a return conduit for returning the first cooling fluid from the radiator to the cylinder head,
- a by-pass conduit by-passing the radiator,
- a first flow regulating valve for regulating the flow fluid through the radiator, and
- a pump for activating circulation of the first cooling fluid in the first circuit. This pump may be driven by the internal combustion engine, or may be provided with an associated driving adjustable electric motor. In one exemplary embodiment, within said by-pass conduit there is interposed a radiator for heating the motor-vehicle compartment.

In the above mentioned case in which the entire flow of the first cooling fluid flows through the heat exchanger, this heat exchanger is interposed within said output conduit of the first cooling circuit. In the case instead in which only a portion of the entire flow of the first cooling fluid flows through the heat exchanger, the heat exchanger is interposed in an auxiliary conduit which departs from said return conduit, in parallel to the cylinder head, a second flow regulating valve being interposed within this auxiliary conduit.

The flow regulating valve for regulating the flow of the first cooling fluid through the radiator of the circuit for cooling the cylinder head may be a conventional thermostatic valve or a proportional solenoid valve. Similarly, the above mentioned second flow regulating valve provided in said auxiliary conduit of the circuit for cooling the cylinder head, in the variant in which only a portion of the entire flow of the first fluid is used to cool the second fluid, may be proportional solenoid valve.

In the case of the preferred embodiment in which the second cooling fluid is the engine lubricating oil, the second circuit for cooling the engine block comprises a conduit for taking the lubricating oil from the engine oil pan and feeding heat to the engine block for cooling thereof, a conduit for feeding the oil after that it has cooled the engine block, to said heat exchanger, a conduit for returning the oil from the heat exchanger to the engine where the oil flows in the lubricating circuit and finally returns to the engine oil pump. In the return conduit of lubricating oil from the heat exchanger to the engine block there is interposed a filter. Also, preferably in parallel to this return conduit of the lubricating oil from the heat exchanger to the engine block there is arranged a by-pass conduit with an associated flow regulating valve by which a portion of the oil flow can be brought from the heat exchanger directly to the engine oil pump.

The engine according to the invention is further preferably provided with an electronic control unit which controls a plurality of electric devices associated to the cooling system, such as flow regulating proportional solenoid valves, and electric motors for driving pumps and the fan associated to the radiator, depending upon signals coming from sensors of various operating parameters of the engine, including a sensor of the temperature of the second fluid at the output from the heat exchanger and a sensor of the temperature of the metal body of the engine block.

Due to all the above indicated feature, the engine according to the invention is able to cool the cylinder head and the engine block efficiently and according to separate criteria. The use of the lubricating oil as a cooling fluid for the engine block enables the temperature of the lubricating oil to be kept under control at all speeds and loads of the engine. In particular, the temperature of the oil is always kept relatively high, so as to achieve a lower viscosity of the oil with resulting advantages of lower friction at the lubricated parts, lower power required for the oil pump and hence lower fuel consumption by the engine and lower emission of noxious gases at the exhaust. The higher operating temperature of the engine block enables the friction at the cylinder walls to be reduced and the combustion chamber to become more adiabatic, i.e. a greater quantity of heat to be converted into mechanical energy.

Figure 2:
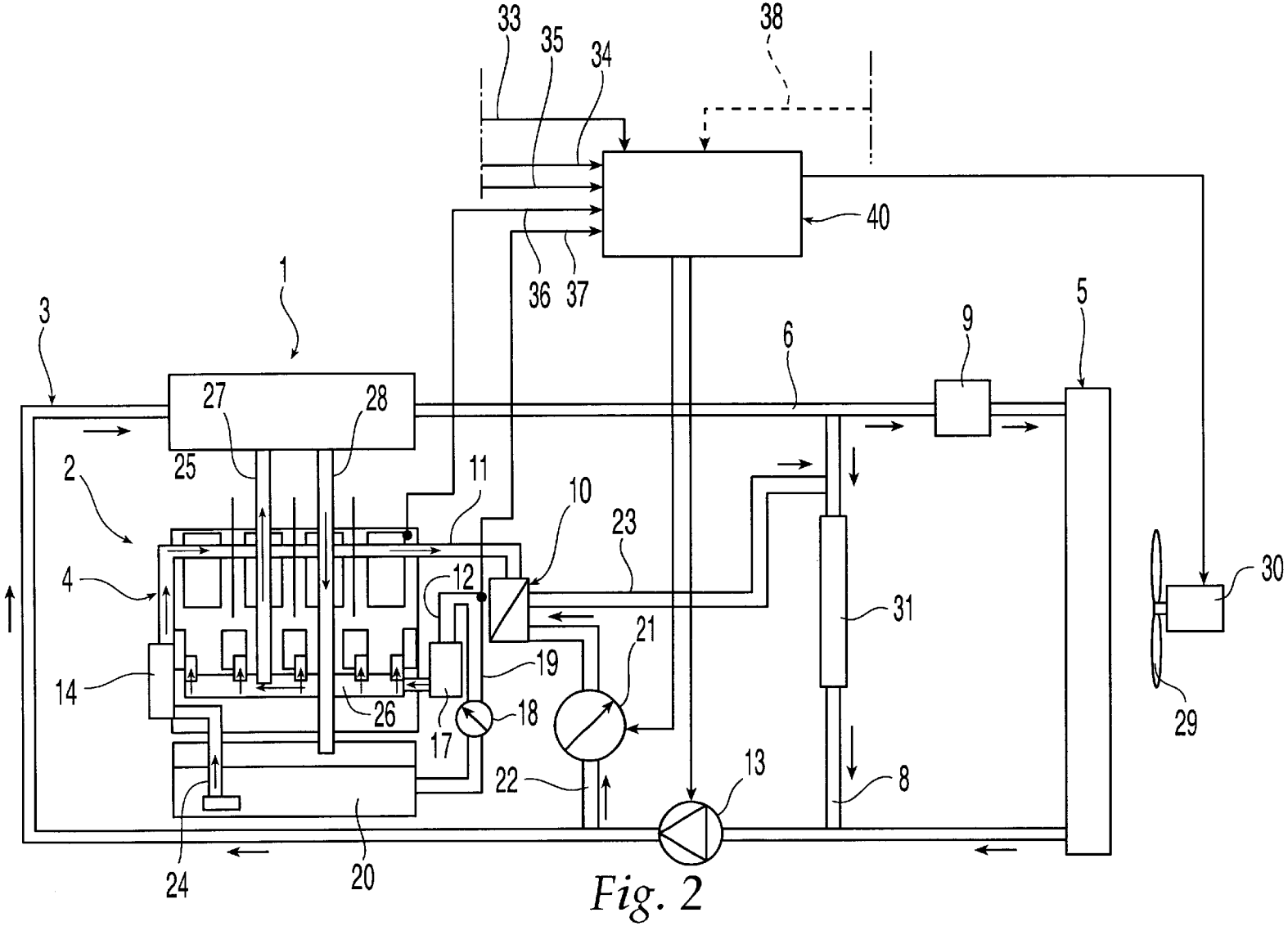

Further features and advantages of the invention will become apparent from the description which follows with reference to the annexed drawings, given purely by way of non limiting example, in which:

FIG. 1 shows a diagram of the first embodiment of the cooling system according to the invention, and FIG. 2 is a diagram of a second, preferred, embodiment of the invention.

In FIG. 1, reference numerals 1, 2 respectively designate the cylinder head and the block of an internal combustion engine of a motor-vehicle. The cooling system of the engine includes a first circuit 3 for cooling the head 1 and a second circuit 4 for cooling the block 2, which are completely separated from each other and make use respectively of a first fluid and a second fluid which are never mixed with each other. The circuit 3 for the cylinder head 1 comprises a radiator 5 a conventional type, an output conduit 6 for feeding the cooling fluid from the head 1 to the radiator 5, a return conduit 7 for returning the cooling fluid from the radiator 5 to the cylinder head 1, a by-pass conduit 8 arranged in parallel to the radiator 5, a flow regulation valve 9 for regulating the flow through the radiator 5.

The engine block 2 is provided with a small circuit 4 independent from the circuit 3, which includes a liquid/liquid heat exchanger made in any known way and designated by reference numeral 10. The exchanger 10 has one of its two ways interposed in the output conduit 6 of the circuit for cooling the head 1. The circuit 4 for cooling the block includes an output conduit 11 for feeding the fluid from the engine block 2 to the exchanger 10, and a return conduit 12 for returning the fluid from the heat exchanger 10 to the engine block 2.

In the return conduit 7 of the circuit for cooling the head 1 there is interposed a pump 13 for activating the circulation of the cooling fluid in the first circuit 3, which can be driven in rotation by the internal combustion engine by means of a transmission of any known type, or it can be provided with an associated driving adjustable electric motor. In the return conduit 12 of the circuit 4 for cooling the engine block 2 a small pump 14 is interposed which may be driven by the internal combustion engine, or by an adjustable electric motor. A conduit 16 is further provided for by-passing the exchanger 10, in which a flow regulating valve 15 is interposed such as a proportional solenoid valve. The flow regulating valve 9 provided in the first circuit 3 may be a thermostatic valve of a conventional type or also a proportional solenoid valve.

As already indicated in the foregoing, the circuit 4 for cooling the engine block 2 makes use preferably of a high boiling point fluid, which enables a temperature to be reached at the engine block also much greater than 100° C., such as in the order of 140° C., to the advantage of the engine efficiency. The cooling fluid used in the first circuit 3 may instead be any fluid of known type conventional used in cooling systems for internal combustion engines.

As already indicated in the foregoing, the provision of two cooling circuits 3, 4 for the cylinder head 1 and the engine block 2 which are completely separated from each other enables the engine block 2 to be brought to the required temperature very easily by varying the flow of the fluid in the engine block 2 by means of the pump 14, in case this pump is driven electrically. In the case instead which will be discussed in the following with reference to FIG. 2, in which the second cooling fluid is the engine lubricating oil, this object is obtained by adjusting the portion of the flow of the first cooling fluid which is used for cooling the second cooling fluid. This solution will be discussed, as already indicated, in detail in the following with reference to FIG. 2. In the case of FIG. 1, the liquid which circulates in the engine block 2 is cooled by the entire flow of the liquid which circulates in the head 1, by means of the liquid/liquid heat exchanger 10 which as a small and inexpensive structure. The cooling circuit for the engine block 2 is relatively small. The quantity of liquid contained therein is little. The circuit may be sealed, and directly mounted on the engine and placed at a protected position in the engine compartment, so that it is not liable to inconveniences in the case of damages to the radiator 5, or shocks such as to normally cause damage of the radiator and leakage of cooling liquid. In this manner, the main problems due to the use of high boiling point cooling fluids, i.e. the high cost and the need of replacement in case of leakage due to an accident, are dramatically reduced. Furthermore, in the vary rare case which the fluid has to be replaced, this can be replaced also with a conventional fluid (in the case of the embodiment shown in FIG. 1) after that the electronic unit which controls the engine has been adjusted in order to keep the temperature of the cooling fluid at lower values, which are typical of a conventional engine, by modifying the operation of the electric pump. As also already indicated, the pump 14 is very small, can be installed easily, is inexpensive and in case of an electric pump does not overcharge the alternator of the motor-vehicle electric system. FIG. 2 shows a preferred embodiment in which the second cooling fluid is the engine lubricating oil. In this figure, the parts in common to those of FIG. 1 are designated by the same reference numeral. As already indicated above, an important difference of the solution shown in FIG. 2 with respect to that of figure lies in that in the case of the system of FIG. 2 the second cooling fluid, i.e. the engine lubricating oil, is cooled only by a portion of the entire flow of the first cooling fluid. To this end, from the return conduit 7 coming to the radiator 5 there departs a conduit 22 which feeds a portion of the flow of the first cooling fluid to the heat exchanger 10. Once this portion of the first cooling fluid flow has crossed the exchanger, it returns to the by-pass conduit 8 through a conduit 23, so that it goes in circulation without passing through the cylinder head 1. The quantity of the first cooling fluid which flows through the heat exchanger 10 is regulated by means of a flow regulating valve, which may be, for example, a proportional solenoid valve. In the by-pass conduit 8 there is further interposed a radiator 31 for heating the motor-vehicle compartment.

With reference to circuit 4 for cooling the engine block, this circuit comprises a passage 25 which is crossed by the lubricating oil of the engine in order to cool the engine block. The oil comes to passage 25 from the engine oil pan 20, from which the oil is taken through a conduit 24 by means of the pump 14 of the engine lubricating circuit, which in this case is used also for activating the circulation of the oil in the circuit for cooling the engine block. The pump 14 is typically driven by the internal combustion engine, even if the possibility is not excluded to provide an adjustable electric motor for driving this pump. After that the engine block has been cooled, the lubricating oil comes to the heat exchanger 10 through the conduit 11, so as to cool down by transferring heat to the first cooling fluid coming from conduit 22. The oil then returns to the engine block through a conduit 12 in which a filter 17 is interposed. The oil is then sent to the engine lubricating circuit, including a passage 26 through which the oil comes to the parts to be lubricated contained in the engine, a conduit 27 for feeding the oil to the circuit for lubricating the head 1 and a conduit 28 for returning the lubricating oil from the cylinder head to the engine oil pan 20. Preferably, a by-pass conduit 19 is provided, controlled by a flow regulating valve 18, such as a proportional solenoid valve, by which part of the oil coming from the heat exchanger 10 returns directly into the oil pan 20.

In the preferred embodiment shown in FIG. 2, an electronic control unit 40 is provided for controlling the operation of the proportional solenoid valve 21, an electric motor 30 driving the fan 29 associated to the radiator 5, and an adjustable electric motor driving the pump 13 for feeding the first cooling fluid (this pump however may be also of the type driven directly by the internal combustion engine, as already indicated above). The control unit 40 controls the above mentioned devices on the basis of a number of signals indicating the various operating parameters of the engine, such a signal 33 of the engine rotational speed, a signal 34 of the outside temperature, a signal 35 of the motor-vehicle speed, a signal 36 of the temperature of the metal body of the engine block, a signal 37 of the temperature of the oil at the output from the heat exchanger 10, and any further signals 38 representing further parameters of operation. The valve 9, as already indicated, may be a conventional thermostatic valve, for example calibrated to shut-off for temperature values lower than 70° C., but it may also be a proportional solenoid valve electronically controlled by unit 40.

From the foregoing description, it is clearly apparent that the principle at the basis of the invention is that of providing two separate cooling circuits for the cylinder head and the engine block, with two separate fluid which are never mixed with each other, and in which the flow of the first cooling of the head is used, entirely or partially, for cooling down the second cooling fluid of the engine block. The second fluid for cooling the engine block is preferably a high boiling point fluid, which provides the advantage of a higher operating temperature for the engine block, as already indicated in the foregoing. In the preferred embodiment shown in FIG. 2, in which this high boiling point fluid is the engine lubricating oil, the further advantages obtained of keeping the temperature of the lubricating oil relatively high at all speeds and loads of the engine, which decreases the frictions, due to the lower viscosity of the oil, and thus reduces the fuel consumption and the noxious gases at the exhaust.

Naturally, while the principle of the invention remains the same, the details of construction and the embodiments may widely vary with respect to what has been described and shown purely by way of example, without departing from the scope of the present invention.

What is claimed is:

1. An internal combustion engine comprising an engine block and a cylinder head wherein said engine includes a cooling system having a first cooling circuit for the cylinder head of the engine and a second cooling circuit for the engine block which are completely separated from each other, a first cooling fluid and a second cooling fluid in said first and second circuits respectively which are never mixed with each other and a liquid/liquid heat exchanger having passages respectively interposed in the first circuit for cooling the cylinder head and in the second circuit for cooling the engine block for transferring heat between said two fluids, wherein the cooling circuit of the cylinder head comprises a radiator, an output conduit for feeding the first cooling fluid from the cylinder head to the radiator, a return conduit for returning the first cooling fluid from the radiator to the cylinder head, a bypass conduit for bypassing the radiator, a first flow regulating valve for regulating the flow of fluid through the radiator and a pump for activating the circulation of the first cooling fluid in the first cooling circuit and wherein a radiator for heating a motor vehicle passenger compartment is disposed in said bypass conduit.

2. An internal combustion engine comprising an engine block and a cylinder head wherein said engine includes a cooling system having a first cooling circuit for the cylinder head of the engine and second cooling circuit for the engine block which are completely separated from each other, a first cooling fluid and a second cooling fluid disposed in said first and second cooling circuits respectively which are never mixed with each other and a liquid/liquid heat exchanger having two passages respectively interposed in the first circuit for cooling the cylinder head and in the second circuit for cooling the engine block for transferring heat between said two fluids, wherein the cooling circuit of the cylinder head comprises a radiator, an output conduit for feeding the first cooling fluid from the cylinder head to the radiator, a return conduit for returning the first cooling fluid from the radiator to the first cylinder head, a bypass conduit for bypassing the radiator, a first flow regulating valve for regulating the flow of fluid through the radiator and a pump for activating the circulation of the first cooling fluid in the first circuit, wherein the heat exchanger is disposed in an auxiliary conduit extending between the return conduit and the bypass conduit and a second flow regulating valve is interposed in said auxiliary conduit for permitting only a portion of the entire flow of the first cooling fluid through said heat exchanger.

3. An internal combustion engine as set forth in claim 2 wherein said second flow regulating valve in the auxiliary conduit is a proportional solenoid valve.

4. An internal combustion engine comprising an engine block and a cylinder head wherein said engine includes a cooling system having a first cooling circuit for the cylinder head of the engine and second cooling circuit for the engine block which are completely separated from each other and a first cooling fluid and a second cooling fluid disposed in said first and second cooling circuits respectively which are never mixed with each other and a liquid/liquid heat exchanger having two passages respectively interposed in the first circuit for cooling the cylinder head and in the second circuit for cooling the engine block to transfer heat between said two fluids wherein the second cooling circuit for cooling the engine block comprises an output conduit for feeding the cooling fluid from the engine block to the heat exchanger, a return conduit for returning the cooling fluid from the heat exchanger to the engine block and a second pump for circulating the second cooling fluid in the second circuit, wherein the second cooling fluid is the engine lubricating oil and wherein the return conduit of the second cooling circuit is connected to a circuit for lubricating the engine block and the cylinder head with said engine lubricating oil.

5. An internal combustion engine according to claim 4 wherein the pump of the second cooling circuit is the pump of the engine lubricating circuit.

6. An internal combustion engine according to claim 5 wherein a filter is interposed in said return conduit.

7. An internal combustion engine according to claim 6 wherein a bypass conduit having a flow regulating valve is connected in parallel to said return conduit for returning a portion of the lubricating oil from the heat exchanger directly to the oil sump.

* * * * *